US011035143B2

(12) United States Patent
Shalouf

(10) Patent No.: US 11,035,143 B2
(45) Date of Patent: Jun. 15, 2021

(54) SYSTEMS AND METHOD FOR ADJUSTING A DRILLING RIG

(71) Applicant: Saudi Arabian Oil Company, Dhahran (SA)

(72) Inventor: Fathalla Shalouf, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/548,387

(22) Filed: Aug. 22, 2019

(65) Prior Publication Data

US 2021/0054645 A1 Feb. 25, 2021

(51) Int. Cl.
*E04H 12/34* (2006.01)
*E21B 15/00* (2006.01)

(52) U.S. Cl.
CPC ..... *E04H 12/345* (2013.01); *E21B 15/00* (2013.01)

(58) Field of Classification Search
CPC ..... E04H 12/345; E21B 15/00
See application file for complete search history.

(56) References Cited

U.S. PATENT DOCUMENTS 2,808,911 A 10/1957 McLerran
2,887,191 A * 5/1959 Lovell ..... E21B 15/00 52/115
2,934,905 A * 5/1960 Woolslayer ..... E21B 15/02 405/209
2,993,570 A 7/1961 Bender
3,245,180 A 4/1966 Bules et al.
3,747,695 A 7/1973 Branham
4,267,675 A * 5/1981 Cochran ..... E21B 7/023 212/348
4,447,997 A 5/1984 Delgado
4,821,816 A * 4/1989 Willis ..... E21B 15/00 175/57
6,594,960 B2 * 7/2003 Brittain ..... E21B 15/00 175/202

(Continued)

FOREIGN PATENT DOCUMENTS

EP 2642064 A1 * 9/2013 ..... E21B 15/00

OTHER PUBLICATIONS

PCT International Search Report and Written Opinion in International Application No. PCT/US2020/046,969, dated Nov. 4, 2020, 13 pages.

(Continued)

*Primary Examiner* — Rodney Mintz
(74) *Attorney, Agent, or Firm* — Fish & Richardson P.C.

(57) ABSTRACT

A drilling rig system includes a drilling rig that includes a mast, a pair of hydraulic pistons coupled to a pair of front legs of the mast and configured to apply a first force to the mast, the first force acting in a direction opposing a force generated by a weight of the mast, a plurality of raising lines coupled to a crown block of the mast and to a pair of rear legs of the mast opposite the front legs and configured to apply a second force to the mast, the second force acting in a direction opposing the force generated by the weight of the mast, and a drawworks assembly coupled to the plurality of raising lines and configured to apply a force acting away from the crown block of the mast to at least one of the plurality of raising lines to generate the second force.

25 Claims, 4 Drawing Sheets

(56) References Cited

U.S. PATENT DOCUMENTS

| | | | | |
|---|---|---|---|---|
| 7,306,055 | B2 * | 12/2007 | Barnes | E21B 7/02 175/122 |
| 8,046,959 | B2 * | 11/2011 | Stoetzer | E21B 15/00 52/116 |
| 8,468,753 | B2 * | 6/2013 | Donnally | E21B 7/023 52/117 |
| 8,549,815 | B2 * | 10/2013 | Donnally | E21B 7/02 52/745.17 |
| 8,720,128 | B2 * | 5/2014 | Vogt | E21B 15/00 52/116 |
| 8,875,447 | B2 * | 11/2014 | Flusche | E21B 19/165 52/111 |
| 9,016,004 | B2 * | 4/2015 | Vogt | E04H 12/18 52/118 |
| 9,140,066 | B2 * | 9/2015 | Lanzl | E21B 7/02 |
| 9,249,626 | B2 * | 2/2016 | Flusche | E21B 7/026 |
| 9,512,676 | B2 * | 12/2016 | Holst | E21B 15/00 |
| 9,574,403 | B2 * | 2/2017 | Ferrari | E21B 7/023 |
| 9,926,719 | B2 * | 3/2018 | Reddy | E21B 15/00 |
| 10,125,512 | B2 * | 11/2018 | Allen | E21B 15/00 |
| 10,329,788 | B2 * | 6/2019 | Jonah | E04H 12/345 |
| 10,697,243 | B2 * | 6/2020 | Lee | E21B 15/003 |
| 10,961,780 | B2 * | 3/2021 | Chen | E21B 15/003 |
| 2003/0051915 | A1 * | 3/2003 | Brittain | E21B 15/00 175/52 |
| 2005/0193645 | A1 * | 9/2005 | Barnes | E21B 7/02 52/120 |
| 2009/0200856 | A1 * | 8/2009 | Chehade | E21B 7/02 299/30 |
| 2009/0218139 | A1 * | 9/2009 | Donnally | E21B 15/00 175/57 |
| 2009/0218144 | A1 * | 9/2009 | Donnally | E21B 7/02 175/162 |
| 2009/0320385 | A1 * | 12/2009 | Stoetzer | E02D 7/16 52/118 |
| 2013/0140091 | A1 * | 6/2013 | Lanzl | E21B 7/02 175/57 |
| 2013/0340355 | A1 | 12/2013 | Flusche | |
| 2013/0343858 | A1 * | 12/2013 | Flusche | E21B 19/155 414/800 |
| 2014/0090333 | A1 * | 4/2014 | Vogt | E21B 15/00 52/651.05 |
| 2014/0298735 | A1 | 10/2014 | Vogt | |
| 2015/0240562 | A1 * | 8/2015 | Ferrari | E21B 7/023 52/118 |
| 2016/0040491 | A1 * | 2/2016 | Law | E21B 7/02 175/24 |
| 2016/0298394 | A1 * | 10/2016 | Padira | E04H 12/345 |
| 2017/0247902 | A1 * | 8/2017 | Jonah | E21B 7/02 |
| 2017/0335589 | A1 * | 11/2017 | Allen | E04H 12/187 |
| 2018/0016855 | A1 * | 1/2018 | Lee | E21B 7/024 |
| 2020/0048965 | A1 * | 2/2020 | Chen | E21B 15/003 |

OTHER PUBLICATIONS hydratech-industries.com' [online], "Hydraulic Cylinders for Land-Based Rig Equipment," available on or before Sep. 18, 2016, via the Wayback Machine URL <https://web.archive.org/web/20160918074305/http://www. hydratech-industries.com/industries-applications/land-based-rig-equipment>, retrieved on Apr. 8, 2019, retrieved from URL <http://www.hydratech-industries.com/industries-applications/land-based-rig-equipment>, 4 pages.

iadc.org', [online], "IADC Drilling Manual (preview)", available on or before 2015, retrieved on Apr. 8, 2019, retrieved from URL <http://www.iadc.org/wp-content/uploads/2015/08/preview-dmfull.pdf>, 5 pages.

lcm-wci.com' [online], "Conventional Cantilever Mast," available on or before 2015, retrieved on Apr. 8, 2019, retrieved from URL <http://www.lcm-wci.com/product/conventional-cantilever-mast-2/>, 2 pages.

lcm-wci.com' [online], "Hydraulically Raised Substructure," available on or before 2015, retrieved on Apr. 8, 2019, retrieved from URL <http://www.lcm-wci.com/product/hydraulically-raised/>, 2 pages.

offshore-technology.com' [online], "Hyco Canada," available on or before Nov. 4, 2011, via Wayback Machine URL <https://web.archive.org/web/20111104225906/https://www.offshore-technology.com/contractors/lifting/hycocylinders/>, retrieved on Apr. 8, 2019, retrieved from URL <https://www.offshore-technology.com/contractors/lifting/hycocylinders/>, 11 pages.

* cited by examiner

SYSTEMS AND METHOD FOR ADJUSTING A DRILLING RIG

TECHNICAL FIELD

This disclosure relates to apparatus, systems, and methods for raising and lowering a mast of a drilling rig, and, more particularly, raising and lowering a mast of drilling rig with a pair of hydraulic pistons and a plurality of raising lines.

BACKGROUND

Land drilling rigs for oil and gas operations typically include a mast structure. The mast of a drilling rig is used to provide support to a crown block and a drill string of the rig. Drilling rig masts are typically positioned in a horizontal orientation during transportation of the rig to the drilling site, and are then raised to a substantially vertical position at the drilling site. The mast is typically raised at the drilling site. Failure of the raising device during the process of raising or lowering the mast can cause the mast to collapse, resulting in damage to the mast and increased risk of injury to employees at the drilling site. Mechanical failures of mast raising devices are difficult to predict or detect, making prevention of mast collapse particularly challenging.

SUMMARY

In an example implementation, a drilling rig system includes a drilling rig that includes a mast, a pair of hydraulic pistons coupled to a pair of front legs of the mast and configured to apply a first force to the mast, the first force acting in a direction opposing a force generated by a weight of the mast, a plurality of raising lines coupled to a crown block of the mast and to a pair of rear legs of the mast opposite the front legs and configured to apply a second force to the mast, the second force acting in a direction opposing the force generated by the weight of the mast, and a drawworks assembly coupled to the plurality of raising lines and configured to apply a force acting away from the crown block of the mast to at least one of the plurality of raising lines to generate the second force.

In an aspect combinable with the example implementation, each hydraulic piston of the pair of hydraulic pistons is configured to apply half of the first force to the mast.

In another aspect combinable with any of the previous aspects, the first force is greater than the second force.

In another aspect combinable with any of the previous aspects, the first force is at least nine times greater than the second force.

In another aspect combinable with any of the previous aspects, the plurality of raising lines are configured to apply a third force to the mast in response to failure of at least one of the pair of hydraulic pistons, and the third force is greater than or equal to the force generated by the weight of the mast.

In another aspect combinable with any of the previous aspects, the pair of hydraulic pistons is configured to move the mast between a horizontal orientation and a vertical orientation.

In another example implementation, a drilling rig system includes a drilling rig including a mast, a pair of hydraulic pistons coupled to a pair of front legs of the mast, a plurality of raising lines coupled to a crown block of the mast and to a pair of rear legs of the mast opposite the front legs, and a drawworks assembly coupled to the plurality of raising lines, and a control system communicably coupled to the drilling rig and configured to perform operations including activating the pair of hydraulic pistons to apply a first force to the mast, the first force acting in a direction opposing a force generated by a weight of the mast, and in response to failure of at least one of the pair of hydraulic pistons, activating the plurality of raising lines to apply a second force to the mast, the second force acting in a direction opposing a force generated by the weight of the mast.

In an aspect combinable with the example implementation, the second force is greater than or equal to the force generated by the weight of the mast.

In another aspect combinable with any of the previous aspects, activating the plurality of raising lines to apply a second force to the mast includes activating the drawworks assembly to apply a force to an at least one of the plurality of raising lines, the force acting away from the crown block of the mast.

In another aspect combinable with any of the previous aspects, the first force is at least nine times greater than the second force.

In another aspect combinable with any of the previous aspects, activating the pair of hydraulic pistons to apply a first force to the mast moves the mast between a horizontal orientation and a vertical orientation.

In another aspect combinable with any of the previous aspects, activating the plurality of raising lines to apply a second force to the mast maintains a current vertical position of the mast.

In another aspect combinable with any of the previous aspects, activating the plurality of raising lines to apply a second force to the mast moves the mast between a horizontal orientation and a vertical orientation.

In another aspect combinable with any of the previous aspects, the operations further include activating the plurality of raising lines to apply a third force to the mast, the third force acting in a direction opposing the force generated by the weight of the mast, and the first force and the third force are applied concurrently.

In another aspect combinable with any of the previous aspects, the first force is greater than the third force.

In another example implementation, a method includes applying a first force to a drilling rig mast using a pair of hydraulic pistons coupled to a pair of front legs of the drilling rig mast, the first force acting in a direction opposing a force generated by a weight of the drilling rig mast, and in response to failure of at least one of the pair of hydraulic pistons, applying a second force to the drilling rig mast using a plurality of raising lines coupled to a crown block of the drilling rig mast and to a pair of rear legs of the drilling rig mast opposite the front legs, the second force acting in a direction opposing the force generated by the weight of the drilling rig mast.

In an aspect combinable with the example implementation, the second force is greater than or equal to the force generated by the weight of the drilling rig mast.

In another aspect combinable with any of the previous aspects, applying a second force to the drilling rig mast using a plurality of raising lines includes applying a force to an end of at least one of the plurality of raising lines using a drawworks assembly coupled to the plurality of raising lines.

In another aspect combinable with any of the previous aspects, applying a second force to the drilling rig mast using a plurality of raising lines includes engaging a brake of a drawworks assembly coupled to at least one of the plurality of the raising lines.

In another aspect combinable with any of the previous aspects, applying a second force to the drilling rig mast using a plurality of raising lines further includes rotating a portion of the drawworks assembly to increase the second force applied by the raising lines to the mast.

In another aspect combinable with any of the previous aspects, the first force moves the drilling rig mast between a horizontal orientation and a vertical orientation.

In another aspect combinable with any of the previous aspects, applying the second force maintains a current vertical position of the drilling rig mast.

In another aspect combinable with any of the previous aspects, applying the second force moves the drilling rig mast between a horizontal orientation and a vertical orientation.

Another aspect combinable with any of the previous aspects further includes applying a third force to the drilling rig mast using the plurality of raising lines, the third force acting in a direction opposing the force generated by the weight of the drilling rig mast, and the first force and the third force are applied concurrently.

In another aspect combinable with any of the previous aspects, the first force is greater than the third force.

In another aspect combinable with any of the previous aspects, the first force is nine times greater than the third force.

Example embodiments of the present disclosure may include one, some, or all of the following features. For example, a drilling rig mast raising apparatus according to the present disclosure may prevent the drilling rig mast from collapsing following failure of one or more raising devices. A drilling rig mast raising apparatus according to the present disclosure may prevent interruptions in the process of raising or lowering a drilling rig mast. A drilling rig mast raising apparatus according to the present disclosure may allow for completion the process of raising or lowering a drilling rig mast following failure of one or more raising devices. A drilling rig mast raising apparatus according to the present disclosure may help prevent injuries caused during raising and lowering a drilling rig mast. A drilling rig mast raising apparatus according to the present disclosure may help prevent injuries caused by failure of a hydraulic raising piston system.

The details of one or more embodiments are set forth in the accompanying drawings and the description below. Other features, objects, and advantages will be apparent from the description and drawings, and from the claims.

DETAILED DESCRIPTION

The present disclosure describes systems, apparatus, and methods for raising a mast of a drilling rig. In some aspects, the drilling rig mast raising system and apparatus are configured to prevent collapse of the drilling rig mast, for example, following failure of one or more of the mast raising devices.

Figure 1:
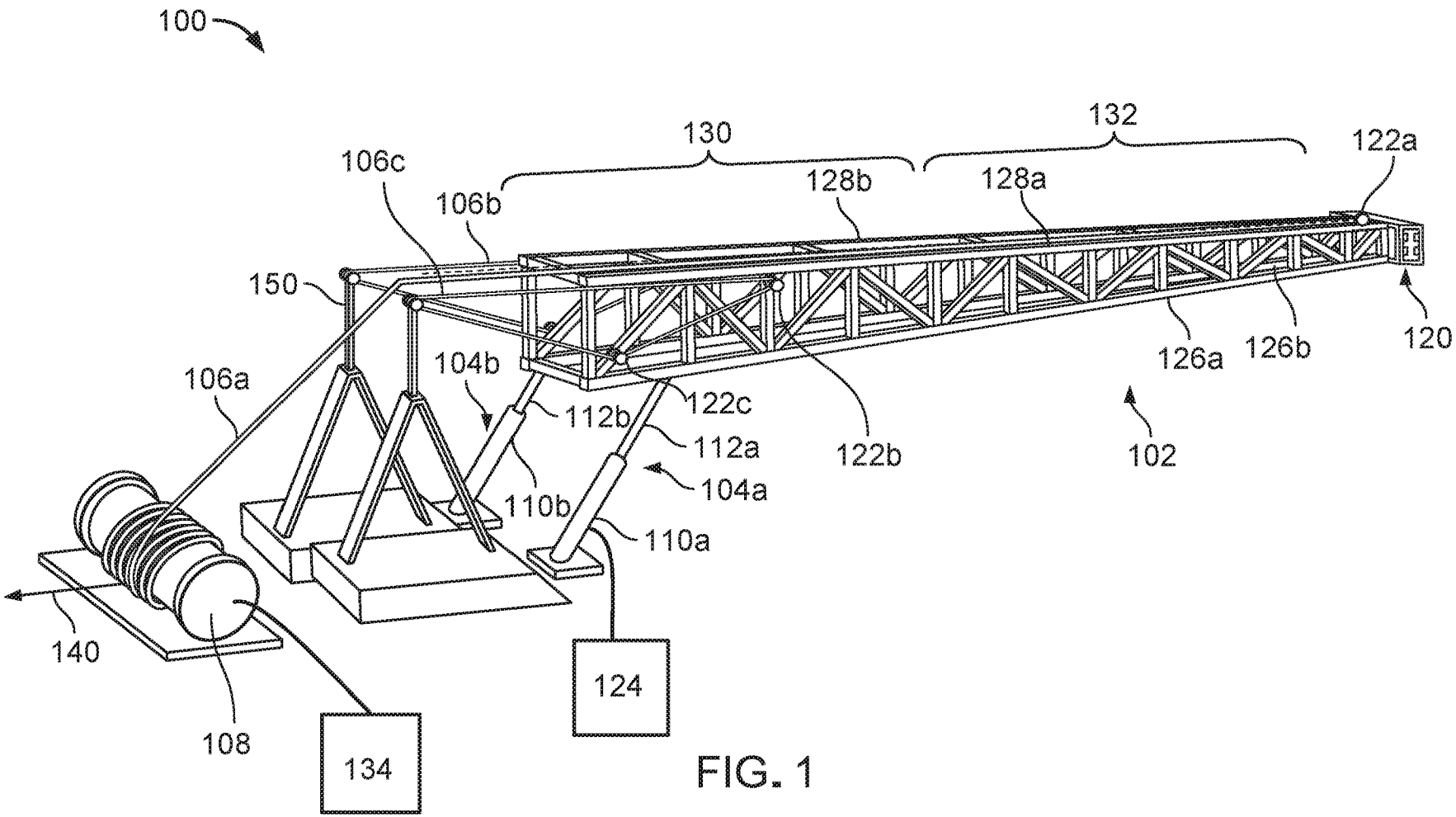
FIGS. 1-3 are schematic illustrations of a drilling rig system that includes an example implementation of a drilling rig mast raising apparatus.

FIG. 1 is a schematic illustration of a drilling rig system 100. The drilling rig system 100 of FIG. 1 includes a drilling rig mast 102, a pair of hydraulic pistons 104*a*, 104*b*, and a plurality of raising lines 106*a*, 106*b*, 106*c*. The drilling rig system 100 may be deployed on a terranean surface to form a wellbore and conduct oil and gas production operations.

In some implementations, the mast 102 of the drilling rig includes a pair of front legs 126*a*, 126*b* and a pair of rear legs 128*a*, 128*b*. The front legs 126*a*, 126*b* may be connected to the rear legs 128*a*, 128*b* to form a mast 102 having a rectangular cross section. As depicted in FIG. 1, each of the rear legs 128*a*, 128*b* are positioned opposite each of the front legs 126*a*, 126*b*. In some implementations, the mast 102 includes a lower portion 130 and an upper portion 132.

In some implementations, the mast includes a crown block 120 located at the top of the mast 102. In some examples, the crown block 120 includes a sets of pulleys for raising and lowering a drilling line into a wellbore.

In the implementation of FIG. 1, the pair of hydraulic pistons 104*a*, 104*b* (referred to collectively as hydraulic pistons 104) are coupled to a lower portion 130 of the mast 102. In some implementations, a first hydraulic piston 104*a* is coupled to a lower portion 130 of first front leg 126*a* of the mast 102 and a second hydraulic piston 104*b* is coupled to a lower portion 130 of a second front leg 126*b* of the mast. In some implementations, the hydraulic pistons 104 are detachably coupled to the mast 102. For example, the hydraulic pistons can be attached to the mast 102 during the processes of raising and lowering the mast 102, and can be detached from the mast 102 during drilling operations or transportation of the mast 102.

In some implementations, the hydraulic pistons 104 are hydraulic piston-cylinder devices that each include a piston 112*a*, 112*b* and a cylinder 110*a*, 110*b* that work together to apply a force to the mast 102. In some examples, each of the hydraulic pistons 104 is configured to apply, for example, an equal force to the mast leg 126*a*, 126*b* to which the respective piston 104*a*, 104*b* is attached. For example, the pistons 104 may be extended at an equal rate of extension to apply the same force to each of the front legs 126*a*, 126*b* of the mast 102. By extending the pistons 112*a*, 112*b* from the cylinders 110*a*, 110*b* at an equal rate, the hydraulic pistons 104 can each apply an equal force to the mast 102 that moves the mast 102 between a horizontal orientation and a vertical orientation.

In some implementations, the hydraulic pistons 104 are coupled to a control system 124. For example, the control system 124 can control the rate of extension of the pistons 104 to apply, for example, a constant, equal force to each of the front legs 126*a*, 126*b* of the mast 102 to raise or lower the mast at a controlled speed.

As depicted in FIG. 1, the plurality of raising lines 106*a*, 106*b*, 106*c* (referred to collectively as raising lines 106) is coupled to the mast 102 at various locations. In some implementations, at least one of the raising lines 106 is coupled to the crown block 120 of the mast 102. In some implementations, one or more of the raising lines 106 are coupled to one or more rear legs 128*a*, 128*b* of the mast 102. In some examples, one or more of the raising lines is attached to one or more rear legs 128*a*, 128*b* of a lower portion 130 of the mast 102. In some implementations, one or more of the raising lines 106 are coupled to one or more sheaves 122*a*, 122*b*, 122*c* that are attached to the mast 102. In the depicted examples, one of the sheaves 122*a* is attached to the mast 102 at the crown block 120 and one or more of the sheaves 122*b*, 122*c* are attached to the rear legs 128*a*, 128*b* of a lower portion 130 of the mast 102. In some implementations, the raising lines 106 are wrapped around the sheaves 122*a*, 122*b*, 122*c*, and the sheaves 122*a*, 122*b*,

122*c* act as pulleys for the raising lines as the mast 102 is being raised or lowered. In some implementations, the raising lines 106 are coupled to one or more portions of a substructure 150. For example, the raising lines can be wrapped around one or more sheaves attached to one or more legs of the substructure 150.

In some implementations, the plurality of raising lines 106 is coupled to a drawworks assembly 108. In some implementations, an end of at least one of the raising lines 106 is coupled to the drawworks assembly 108. In some examples, an end of each of the raising lines 106 is coupled to the mast 102 and an opposite end of each of the raising lines 106 is coupled to the drawworks assembly 108. In some instances, a portion of drawworks assembly 108 rotates to apply a force 140 to the end of at least one of the raising lines 106 and create tension in the raising lines 106. In some examples, a portion of drawworks assembly 108 rotates to apply a force 140 to the end of each of the raising lines 106 and create tension in the raising lines 106. In some examples, the drawworks assembly 108 is positioned such that the force 140 applied to the ends of the raising line(s) 106 acts in a direction away from the crown block 120. In some implementations, the force 140 applied to the raising line(s) 106 by the drawworks assembly 108 is transferred to the mast 102.

As explained in further detail herein, in some implementations, the force 140 applied by the raising lines 106 to the mast 102 maintains the orientation of the mast 102. In some examples, the force 140 applied by the raising lines 106 to the mast 102 acts to raise or lower the mast 102.

In some implementations, the drawworks assembly 108 is coupled to the control system 134. For example, the control system 134 can control the speed of the drawworks assembly 108 such that the drawworks assembly 108 applies a force 140 to at least one of the raising lines 106, which in turn apply a force to the mast 102 to maintain the position of the mast 102 or raise or lower the mast 102 at a controlled speed.

Figure 2:
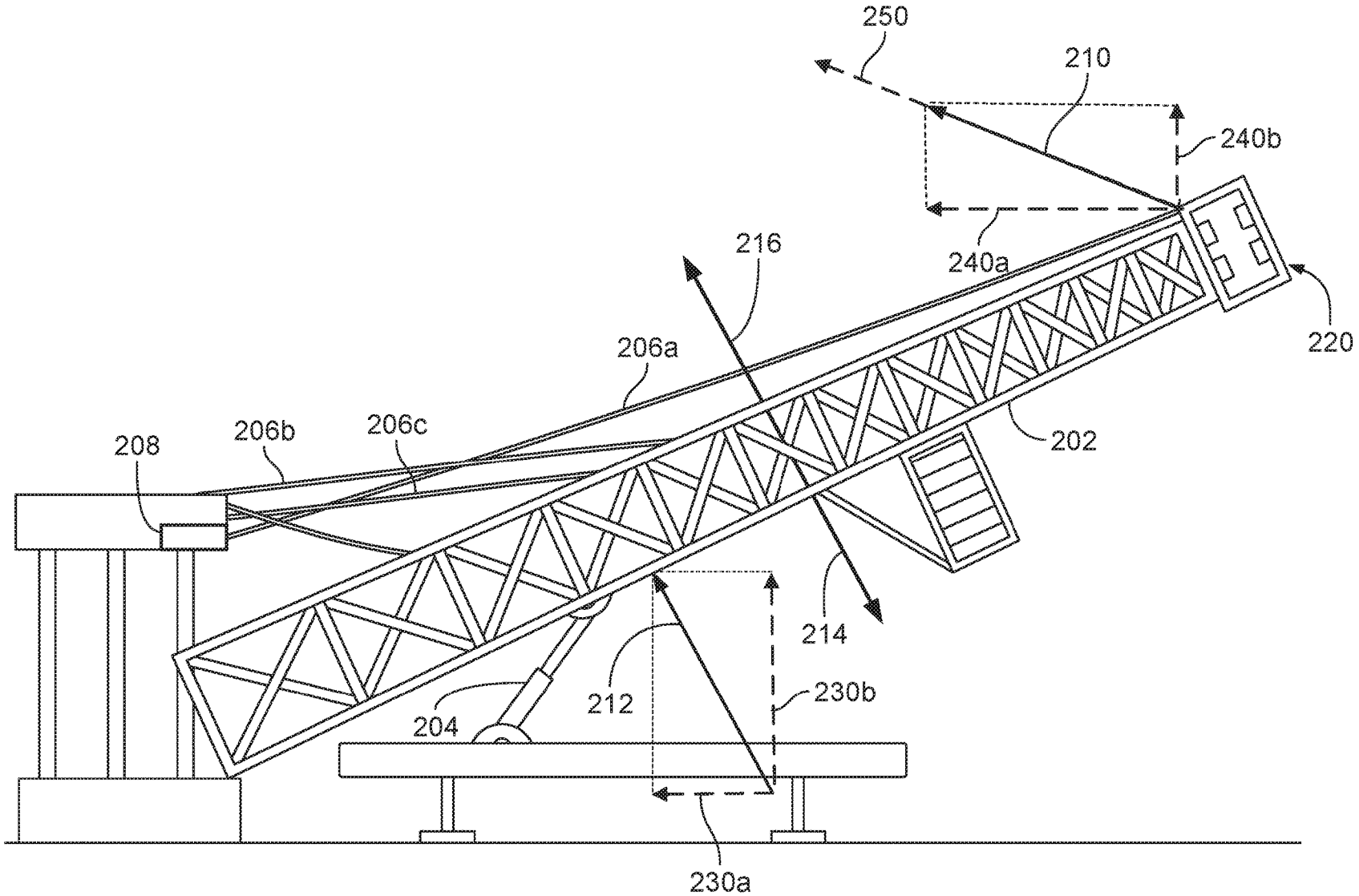

FIG. 2 is a side view of an example drilling rig system 200. The system 200 of FIG. 2 includes a mast 202, a pair of hydraulic pistons 204, and a plurality of raising lines 206*a*, 206*b*, 206*c*. As depicted in the implementation of FIG. 2, the hydraulic pistons are coupled to a pair of front legs of the mast 202 (such as, front legs 128*a*, 128*b* of FIG. 1). In some implementations, the raising lines 206*a*, 206*b*, 206*c* (referred to collectively as raising lines 206) are coupled to a crown block 220 of the mast 202 and to a pair of rear legs of the mast 202. In some example, the at least one of the raising lines 206 is coupled to a drawworks assembly 208. In some examples, an end of each of the raising lines 206 is coupled the drawworks assembly 208.

In some implementations, the pair of hydraulic pistons 204 apply a force 212 to the mast 202. In some implementations, the force 212 applied by the hydraulic pistons 204 to the mast 202 is generated by hydraulically extending each of the hydraulic pistons 204 outward from a cylinder (such as cylinders 110*a*, 110*b* of FIG. 1). For example, hydraulically extending each of the hydraulic pistons 204 applies a force to the front legs of the mast 202 to which the pistons 204 are coupled.

As shown in the implementation of FIG. 2, the force 212 generated by the hydraulic pistons 204 can include both a horizontal component 230*a* acting away from the crown block 220 of the mast 202 and a vertical component 230*b* acting away from the terranean surface. In some examples, the ratio between the vertical component 230*b* of the force 212 generated by the hydraulic pistons 204 and the horizontal component 230*a* of the force 212 changes as the angle between the mast 202 and the terranean surface changes during the processes of raising or lowering the mast 202.

In some implementations, each of the hydraulic pistons 204 generates an equal force. In some implementations, the force 212 generated by the hydraulic pistons 204 opposes a force 214 generated by the weight of the mast 202. In some instances, the force 212 generated by the hydraulic pistons 204 is greater than the force 214 generated by the weight of the mast 202. For example, the force 212 generated by extension of the hydraulic pistons 204 can be in a direction 216 that opposes the force 214 generated by the weight of the mast 202 and can be greater than the force 214 generated by the weight of the mast 202, causing the mast 202 to be supported by the hydraulic pistons 204 and prevent the mast 202 from collapsing. In some implementations, the hydraulic pistons 204 are configured to raise and lower the mast 202.

In some implementations, the pair of hydraulic pistons 204 is communicably coupled to a control system (such as control system 124 of FIG. 1) and the force 212 applied to the mast 202 by the hydraulic pistons 204 is controlled by the control system. For example, the control system can control the rate of extension of the hydraulic pistons 204 such that the pistons 204 extend at a rate of extension sufficient to apply a force 212 to the mast 202 necessary to raise the mast 202 at a controlled speed. In some examples, the control system adjusts the rate of extension of the hydraulic pistons 204 such that the force 212 applied by the hydraulic pistons 204 controls the movement of the mast 202 between a horizontal orientation and a vertical orientation.

In some implementations, the plurality of raising lines 206 are configured to apply a force 210 to the mast 202. In some implementations, an end of each of the raising lines 206 is coupled to a drawworks assembly 208. For example, the force 210 applied to the mast by the raising lines 206 can be generated by rotating a portion (such as a spool portion) of the drawworks assembly 208. In some implementations, rotation of a portion of the drawworks assembly 208 applies a force at least one of the raising lines 206 coupled to the drawworks assembly 208 and creates tension in the raising lines 206 between the drawworks assembly 208 and the mast 202. In some implementations, rotation of a portion of the drawworks assembly 208 applies a force to the end of each raising line 206 coupled to the drawworks assembly 208 and creates tension in the raising lines 206 between the drawworks assembly 208 and the mast 202.

In some implementations, the drawworks assembly 208 is communicably coupled to a control system (such as control system 134 of FIG. 1) and the force 210 applied to the mast 202 through the raising lines 206 is controlled by the control system. For example, the control system can control the speed of rotation of the drawworks assembly 208 such that a constant force 210 is applied to each of the raising lines and transferred to the mast 202. In some examples, the control system adjusts the rate of rotation of the drawworks assembly 208 such that the force 210 applied to the raising lines controls the speed at which the mast 202 moves between a horizontal orientation and a vertical orientation. In some implementations, the control system adjusts the rate of rotation of a portion of the drawworks assembly 208 such that the force 210 applied to the mast 202 by the raising lines 206 is equal to the force 214 generated by the weight of the mast 202, such that the position of the mast 202 is maintained by the raising lines 206. In some implementations, the control system adjusts the rate of rotation of a portion of the drawworks assembly 208 such that the force 210 applied to the mast 202 by the raising lines 206 is greater than the force 214 generated by the weight of the mast 202, such that the mast 202 is raised by the raising lines 206.

As shown in the implementations of FIG. 2, the force 210 generated by the raising lines 206 can include both a horizontal component 240*a* acting away from the crown block 220 of the mast 202 and a vertical component 240*b* acting away from the terranean surface. In some examples, the ratio between the vertical component 240*b* of the force 210 generated by the raising lines 206 and the horizontal component 240*a* of the force 210 changes as the angle between the mast 202 and the terranean surface changes during the process of raising and lowering the mast 202. In some examples, the rate of rotation of a portion of the drawworks assembly 208 is adjusted such that the raising lines 206 apply a force equal to a percentage of a force 214 generated by the weight of the mast 202. For example, the rate of rotation of a portion of the drawworks assembly 208 can be controlled such that the raising lines 206 apply a force 210 to the mast 202 equal to 10% of the force 214 generated by the weight of the mast 202.

As described in further detail herein, in some implementations, the plurality of raising lines 206 is configured to apply a force 210 to the mast 202 throughout the processes of raising and lowering the mast 202. In some implementations, the raising lines 206 selectively apply a force 210 to the mast 202. For example, in some implementations, the raising lines 206 do not apply a force to the mast 102 during normal mast raising or lowering operations (e.g., mast raising or lowering operations in which no failure of the raising pistons 104 occurs.) In some examples, the raising lines 206 apply a force equal to around 10% of the force generated by the weight of the mast during normal mast raising and lowering operations. In some implementations, the force 210 applied to the mast by the raising lines 206 is greater than the force applied to the mast 202 by the hydraulic pistons 204. In some implementations, the raising lines 206 may be configured to apply a force 210 to the mast 202 that is sufficient to control movement of the mast 202 between a vertical position and a horizontal position.

In some implementations, the force 212 applied to the mast 202 by the pair of hydraulic pistons 204 is greater than the force 210 applied to the mast 202 by the raising lines 206. In some examples, the force 212 applied to the mast 202 by the hydraulic pistons 204 is at least four times greater than the force 210 applied to the mast 202 by the raising lines 206. In some implementations, the force 212 applied to the mast 202 by the hydraulic pistons 204 is nine times greater than the force 210 applied to the mast 202 by the raising lines 206. For example, the force 212 applied to the mast 202 by the hydraulic pistons 204 may be equal to 90% of the force 214 generated by the weight of the mast 202 and the force 210 applied to the mast 202 by the raising lines 210 may be equal to 10% of the force 214 generated by the weight of the mast 202.

In some examples, the load of mast 202 will automatically transfer to the raising lines 206 and apply a force 214 to the raising lines 206 is response to the failure of one or more hydraulic raising pistons 204. For example, upon failure of hydraulic pistons 204, the force 214 generated by the weight of the mast 202 will be automatically transferred to the raising lines 206.

In some implementations, the plurality of raising lines 206 is configured to apply a force 250 to the mast 202 in response to one or more of the pair of hydraulic pistons 204 failing to provide a force 212 to the mast 202 during the processes of raising or lowering the mast 202. In some implementations, the raising lines 206 apply a first force 210 to the mast 202 while the mast 202 is being raised or lowered, and the force 210 applied by the raising lines 206 is increased to an increased force 250 in response to failure of one or more of the hydraulic pistons 204.

In some implementations, failure of the hydraulic pistons 204 can include mechanical or electrical failure of one or more of the hydraulic pistons 204. In some examples, failure of one or more of the hydraulic pistons 204 can cause the hydraulic pistons 204 to apply a reduced amount of force to the mast 202 compared to force 212. In some implementations, failure of one or more of the hydraulic pistons 204 can cause the hydraulic pistons 204 to cease applying any force to the mast 202. In some implementations, the force 250 transmitted to the mast 202 by the raising lines 206 is equal to the force 214 generated by the weight of the mast 202. For example, the raising lines 206 may be configured to apply a force 250 to the mast 202 sufficient to maintain the position of the mast 202 and prevent the mast 202 from collapsing in response to failure of the hydraulic pistons 204 while the mast 202 is being raised or lowered. In some implementations, the force 250 applied by the raising lines 206 to the mast 202 is greater than the force 214 generated by the weight of the mast and is applied in a direction 216 that opposes the force 214 generated by the weight of the mast 202. In some implementations, the raising lines 206 may be configured to apply a force 250 to the mast 202 sufficient to control movement of the mast 202 between a vertical position and a horizontal position following failure of one or more of the hydraulic pistons 204.

In some implementations, the increased force 250 is applied by the raising lines 206 to the mast 202 automatically in response to failure of one or more hydraulic pistons 204. For example, in response to detection by a sensor that one or more hydraulic pistons 204 have failed, the force 210 applied by the raising lines 206 can be automatically increased to an increased force 250 to prevent the mast 202 from collapsing. In some examples, a control system (such as control system 134 of FIG. 1) can receive a signal indicating that an increased force being applied to the raising lines 206 by the mast 202 and, in response, cause the drawworks 208 to increase the force applied to the raising lines 206, which results in an increased force 250 applied by the raising lines 206 to the mast 202 to counter the sensed force.

In some implementations, an operator manually increases the force 210 applied by the raising lines 206 to the mast 202 to an increased force 250 in response to failure of the hydraulic pistons 204. For example, upon detection of a failure of one or more hydraulic pistons 204, an operator can engage a brake mechanism of the drawworks 208 to cause the raising lines 210 to apply an increased force 250 equal to the force 214 generated by the weight of the mast 202 and prevent the mast 202 from collapsing. In some examples, in response to hydraulic raising piston 204 failure, an operator can increase the force 140 applied to at least one of the raising lines 206 by the drawworks 208 to increase the force 210 applied to the mast 202 by the raising lines 206 to an increased force 250 sufficient to raise the mast 202 to a vertical position.

In some examples, after applying the increased force 250 through the raising lines 206 in response to hydraulic piston 204 failure, the hydraulic pistons 204 can be removed from the drilling rig system for repair. In some examples, the increased force 250 applied by the raising lines 206 can be used to complete the process of raising the mast 202 following hydraulic piston 204 failure.

In some examples, the force 214 generated by the weight of the mast 202 is automatically transferred to the hydraulic pistons 204 in response to failure of the raising lines 206. In some implementations, the pair of hydraulic pistons 204 is configured to apply a force 212 to the mast 202 in response to one or more of the raising lines 206 failing or otherwise failing to provide a force 210 to the mast 202 during the processes of raising or lowering the mast 202. In some implementations, failure of the raising lines 206 can include mechanical failure of one or more of the raising lines 206, such as tears or breakages in one or more of the raising lines 206. In some examples, failure of the raising lines 206 includes failure of the drawworks assembly 208. For example, the drawworks assembly 208 can experience electrical or mechanical failure, causing the drawworks assembly 208 to fail to apply an adequate force to the plurality of raising lines 206 to generate force 210. In some examples, failure of one or more of the raising lines 206 can result in the raising lines 206 applying a reduced amount of force to the mast 202 compared to force 210. In some implementations, failure of one or more of the raising lines 206 can cause the raising lines 206 to cease applying any force to the mast 202. In some implementations, the force 212 applied by the hydraulic pistons 204 to the mast 202 is automatically applied in response to failure of one or more of the raising lines 206.

In some implementations, a force 212 applied to the mast 202 by the hydraulic pistons 204 in response to raising line failure is equal to the force 214 generated by the weight of the mast 202. For example, the hydraulic pistons 204 may be configured to apply a force 212 to the mast 202 that is sufficient to maintain the position of the mast 202 and prevent the mast 202 from collapsing following failure of the raising lines 206 during the process of raising or lowering the mast 202. In some implementations, the force 212 applied by the hydraulic pistons 204 to the mast 202 in response to raising line 206 failure is greater than the force 214 generated by the weight of the mast 202 and is applied in a direction 216 that opposes the force 214 generated by the weight of the mast 202. In some implementations, the hydraulic pistons 204 may be configured to apply a force 212 to the mast 202 sufficient to control movement of the mast 202 between a vertical position and a horizontal position following failure of one or more of the raising lines 206.

In some implementations, a control system (such as control system 124 of FIG. 1) controls the extension of the hydraulic pistons 204 in response to raising line 206 failure. For example, the control system can receive a signal indicating that an increased amount of weight is being placed on the hydraulic pistons 204 and, in response, can cause the hydraulic pistons 204 to be extended to apply a force to the mast 202 that opposes the sensed weight. In some examples, an operator increases the force 212 applied by the hydraulic pistons 204 to the mast 202 in response to detecting raising line 206 failure.

Figure 3:
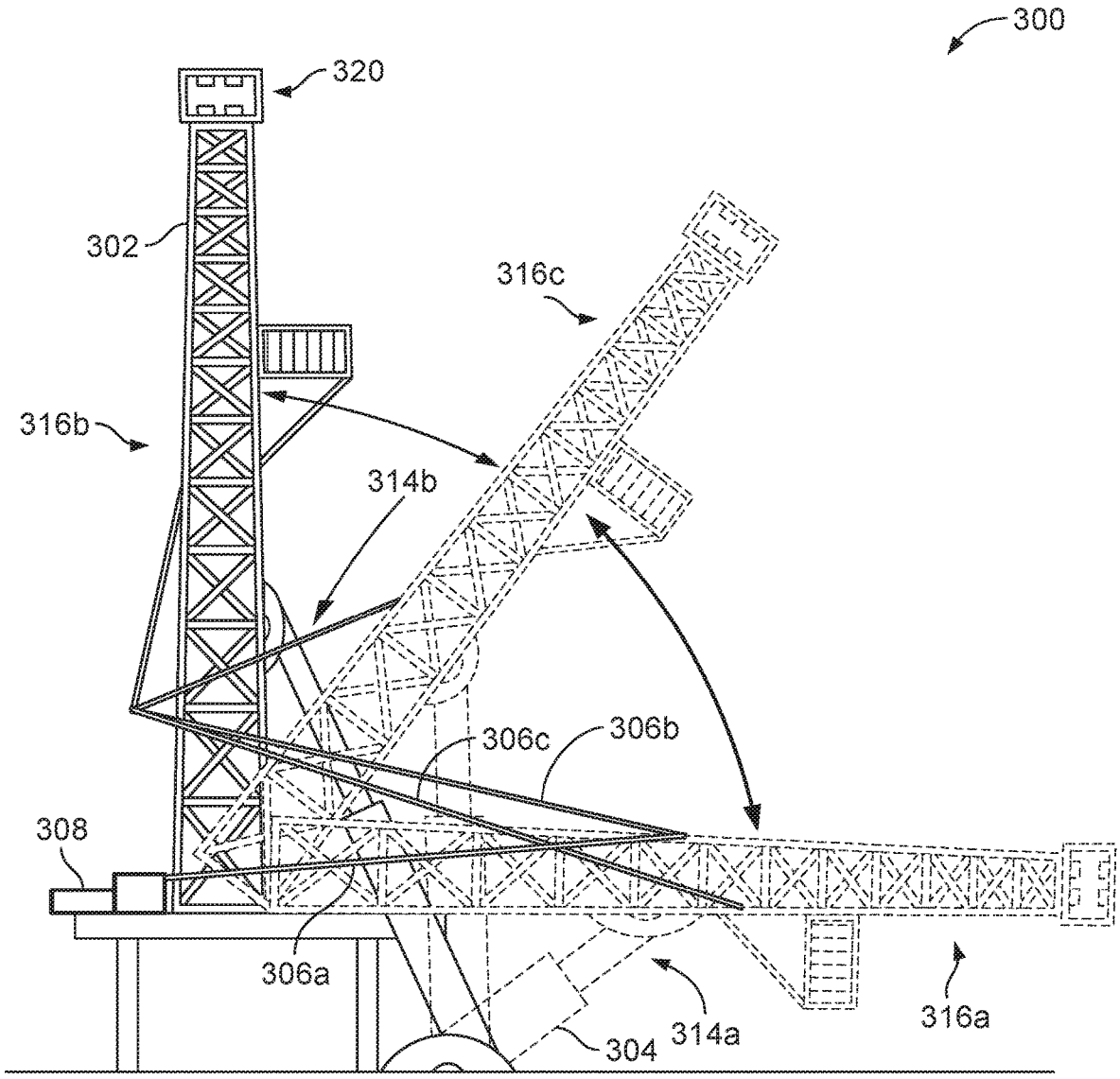

FIG. 3 is a schematic illustration of a drilling rig system 300 at various orientations during the processes of raising and lowering a drilling rig mast 302 of the system 300. In the implementation of FIG. 3, the drilling rig system 300 includes a mast 302, a pair of hydraulic pistons 304, and a plurality of raising lines 306*a*, 306*b*, 306*c*. In some implementations, the plurality of raising lines 306*a*, 306*b*, 306*c* (referred to collectively as raising lines 306) are attached to a drawworks assembly 308.

In some implementations, the mast 302 is raised from a horizontal orientation 316*a* to a vertical orientation 316*b* using the hydraulic pistons 304. For example, when the mast is in the horizontal orientation 316*a*, the hydraulic pistons 304 are coupled to the mast 302 and are in a first, retracted position 314*a*. In some implementations, the hydraulic pistons are extended to a second, extended position 314*b* in order to raise the mast 302 to a vertical orientation 316*b*. In some examples, the extension of the pistons 304 exerts a force on the mast 302 that opposes a force generated by the weight of the mast 302 (such as force 214 of FIG. 2). For example, the mast 302 may be raised from a horizontal orientation 316*a* to a vertical orientation 316*b* at a controlled speed by the hydraulic pistons 304 by controlling the rate of extension of the hydraulic pistons 304. In some implementations, the rate of extension of the hydraulic pistons 304 is controlled such that the mast 302 is raised at a constant speed. In some implementations, the hydraulic pistons 304 are extended at a constant rate of extension until the mast 302 is in a vertical orientation 316*b*. In some implementations, the rate of extension of the hydraulic pistons 304 is controlled by control system (such as control system 124 of FIG. 1).

In some implementations, the hydraulic pistons 304 are used to lower the mast 302 from a vertical orientation 316*b* to a horizontal orientation 316*a*. For example, the mast 302 may be lowered from a vertical orientation 316*b* to a horizontal orientation 316*a* at a controlled speed by the hydraulic pistons 304 prior to transportation of the mast 302. In some examples, the hydraulic pistons 304 are coupled to the mast 302 and the mast 302 is lowered from the vertical orientation 316*b* to the horizontal orientation 316*a* by retracting the hydraulic pistons 304 from an extended position 314*b* to a retracted position 314*a*. For example, the mast 302 may be lowered from a vertical orientation 316*b* to a horizontal orientation 316*a* at a controlled speed by the hydraulic pistons 304 by controlling the rate of retraction of the hydraulic pistons 304. In some implementations, the rate of retraction of the hydraulic pistons 304 is controlled such that the mast 302 is lowered at a constant speed. In some implementations, the hydraulic pistons 304 are retracted at a constant rate of retraction until the mast 302 is in a horizontal orientation 316*a*. In some implementations, the rate of retraction of the hydraulic pistons 304 is controlled by control system (such as control system 124 of FIG. 1).

In some implementations, the raising lines 306 apply a force to the mast 302 during the processes of raising and lowering the mast 302. In some examples, the raising lines 306 are coupled to the mast 302 and an end of each of the raising lines 306 is coupled to the drawworks assembly 308. In some examples, an end of at least one of the raising lines 306 is coupled to the drawworks assembly 308. In some examples, the raising lines 306 are coupled to a crown block 320 of the mast and to a pair of rear legs of the mast 302. In some implementations, the raising lines 306 are coupled to a pair of rear legs of the mast 302 that are opposite the front legs of the mast 302 to which the hydraulic pistons 304 are coupled.

In some examples, rotation of a portion of the drawworks assembly 308 applies a force at least one of the raising lines 306, which generates tension in the raising lines 306 and opposes the force generated by the weight of the mast 302. In some implementations, the drawworks assembly 308 applies a force to an end of each of the raising lines 306, which generates tension in the raising lines 306 and opposes the force generated by the weight of the mast 302. In some examples, the force applied to the raising lines 306 by the weight of the mast 302 is determined based on a load meter coupled to the raising lines 306.

In some implementations, the force applied to the mast 302 by the raising lines 306 is less than the force applied to the mast 302 by the hydraulic pistons 304, such that the force applied to the mast 302 by the hydraulic pistons 304 substantially raises and lowers the mast 302. In some implementations, the force applied to the mast 302 by the hydraulic pistons 304 is nine times greater than the force applied to the mast 302 by the raising lines 306.

In some implementations, the drawworks assembly 308 is communicably coupled to a control system (such as control system 134 of FIG. 1) and the force applied to the mast 302 by the raising lines 306 is controlled by the control system. For example, the control system can control the drawworks assembly 308 such that the speed of rotation of a portion of the drawworks assembly 308 is controlled in order to apply a force to at least one of raising lines 306, which is then transferred to the mast 302. In some implementations, the control system controls the drawworks assembly 308 such that the speed of rotation of a portion of the drawworks assembly 308 is controlled in order to apply a force to at least one of raising lines 306, which is then transferred to the mast 302. In some examples, a control system (such as control system 134 of FIG. 1) can receive a signal indicating that an increased force being applied to the raising lines 306 by the mast 302 and, in response, cause the drawworks 308 to increase the force applied to the raising lines 306, which results in an increased force applied by the raising lines 306 to the mast 302 to counter the sensed force.

In some examples, the load of the mast 302 is automatically transferred to the raising lines 306 in response to hydraulic piston 304 failure. In some examples, the raising lines 306 apply a force to the mast 302 in response to failure of one or more of the hydraulic pistons 304 during the process of raising or lowering the mast 302. For example, one or more of the hydraulic pistons 304 may fail and stop providing a force to the mast 302 while the mast 302 is in an intermediate orientation 316*c* during the raising or lowering process. The raising lines 306 can apply a force to the mast 302 that opposes the force generated by the weight of the mast 302 in response to a hydraulic piston 304 failure. In some examples, the force applied by the raising lines 306 in response to hydraulic piston 304 failure is applied automatically. In some implementations, the force applied by the raising lines 306 to the mast 302 is applied manually by an operator in response to hydraulic piston 304 failure. For example, an operator can engage a brake of the drawworks 308 in response to detecting hydraulic piston 304 failure, and application of the drawworks 308 brake by the operator causes the raising lines 306 to apply an increased force to the mast 302 to prevent the mast from collapsing.

In some examples, the force applied to the mast 302 by the raising lines 306 in response to hydraulic piston 304 failure is greater than or equal to the force generated by the weight of the mast 302. For example, in some implementations, the force applied by the raising lines 306 in response to failure of the hydraulic pistons 304 is sufficient to maintain the intermediate orientation 316*c* of the mast 302 at the time of piston 304 failure. For example, a brake of the drawworks 308 may be engaged, which causes the raising lines 306 to apply a force to the mast 302 sufficient to maintain the intermediate orientations 316*b* of the mast 302 at the moment the brake is engaged and prevent the mast 302 from collapsing. In some examples, the force applied by the raising lines 306 in response to failure of the hydraulic pistons 304 during the raising process is sufficient to complete the raising process and raise the mast 302 to a vertical position 316*b*. For example, after engaging a brake of the drawworks 308 to prevent mast 302 from collapsing following hydraulic piston 304 failure, the operator can control the drawworks 308 to increase the force applied by the raising lines 306 to the mast 302 to raise the mast 302 to a vertical orientation 316*b* at a controlled speed. In some implementations, the force applied by the raising lines 306 in response to failure of the hydraulic pistons 304 during the lowering process is sufficient to lower the mast 302 to a horizontal orientation 316*a* at a controlled speed.

In some implementations, the mast 302 is raised from a horizontal orientation 316*a* to a vertical orientation 316*b* using the raising lines 306. For example, when the mast is in the horizontal orientation 316*a*, the raising lines 306 are coupled to the mast 302 and the drawworks assembly 308 applies a force to at least one of the raising lines 306, which causes the raising lines 306 to apply a force to the mast that raises the mast 302 to a vertical orientation 316*b*. In some implementations, the speed of rotation of the drawworks assembly 308 is controlled to apply a force to at least one of the raising lines 306 such that the mast 302 is raised and lowered by the raising lines 306 at a controlled speed between a horizontal orientation 316*a* and a vertical orientation 316*b*. In some implementations, the speed of rotation of the drawworks assembly 308 is controlled to apply a force to an end of each of the raising lines 306 such that the mast 302 is raised and lowered by the raising lines 306 at a controlled speed between a horizontal orientation 316*a* and a vertical orientation 316*b*.

In some implementations, the raising lines 306 are used to lower the mast 302 from a vertical orientation 316*b* to a horizontal orientation 316*a*. For example, the mast 302 may be lowered at a controlled speed from a vertical orientation 316*b* to a horizontal orientation 316*a* by the raising lines 306 prior to transportation of the mast 302 to another drill site. In some examples, the raising lines 306 are coupled to the mast 302 and the mast 302 is lowered from the vertical orientation 316*b* to the horizontal orientation 316*a* at a controlled speed by using the raising lines 306 to apply a force to the mast 302 opposing the force generated by the weight of the mast 302. In some implementations, the speed of rotation of the drawworks 308 coupled to the raising lines 306 is controlled such that the force applied to at least one of the raising lines 306 lowers the mast 202 at a controlled speed. In some implementations, the speed of rotation of the drawworks 308 coupled to the raising lines 306 is controlled such that the force applied to an end of each of the raising lines 306 lowers the mast 202 at a controlled speed.

In some implementations, the force applied to the mast 302 by the raising lines 306 is greater than the force applied to the mast 302 by the hydraulic pistons 304, such that the force applied to the mast 302 by the raising lines 306 substantially raises and lowers the mast 302.

In some examples, the load of the mast 302 is automatically transferred to the hydraulic pistons 304 following raising line 306 failure and the hydraulic pistons 304 apply a force to the mast 302 in response to failure the raising lines 306. For example, the raising lines 306 may fail and stop providing a force to the mast 302 while the mast 302 is in an intermediate orientation 316*c* during the raising process or the lowering process. The hydraulic pistons 304 can be controlled to apply a force to the mast 302 that opposes the force generated by the weight of the mast 302 in response to a raising line 306 failure. For example, in response to failure of the raising lines 306 during the raising process, the hydraulic pistons 304 can automatically extend to apply a force to the mast 302 that opposes the force generated by the weight of the mast. In some examples, an operator controls the hydraulic pistons 304 to cause the hydraulic pistons 304 to extend and apply an increased force to the mast 302 in response to raising line 306 failure.

In some examples, the force applied to the mast 302 by the hydraulic pistons 304 in response to raising line 306 failure is greater than or equal to the force generated by the weight of the mast 302. In some examples, the force applied by the hydraulic pistons 304 in response to failure of the raising lines 306 is sufficient to maintain the orientation 316*c* of the mast 302 at the time of the raising line 306 failure. In some examples, the force applied by the hydraulic pistons 304 in response to failure of the raising lines 306 during the raising process is sufficient to complete the raising process and raise the mast 302 to a vertical position 316*b*. In some implementations, the force applied by the hydraulic pistons 304 in response to failure of the raising lines 306 during the lowering process is sufficient to lower the mast 302 to a horizontal orientation 316*a* at a controlled speed.

In some implementations, a control system (such as control system 124 of FIG. 1) controls the extension of the hydraulic pistons 304 in response to raising line 306 failure. For example, the control system can receive a signal indicating that an increased amount of weight is being applied to the hydraulic pistons 304 and, in response, cause the hydraulic pistons 304 to be extended to apply a force to the mast 302 to counter the sensed weight.

Figure 4:
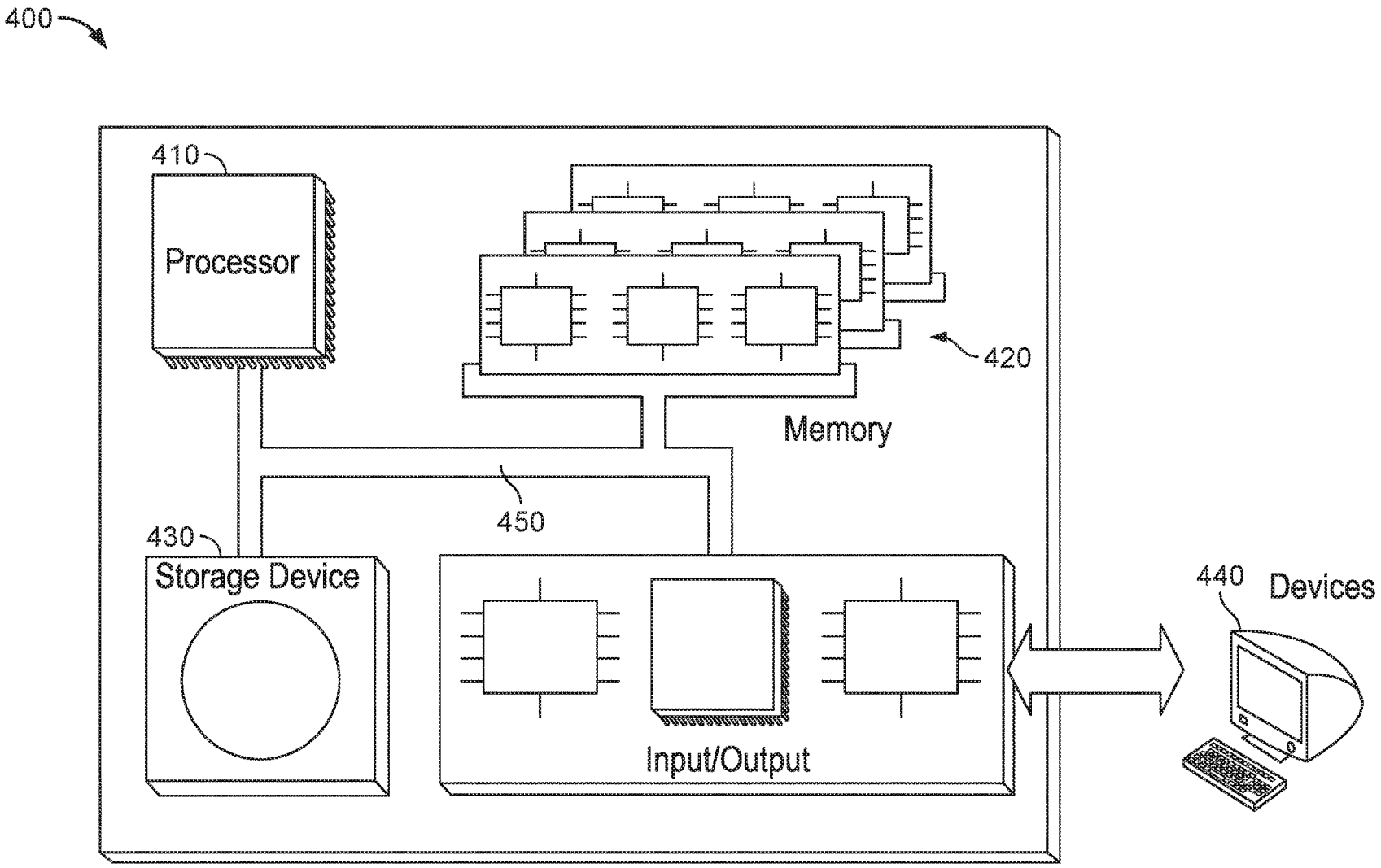
FIG. 4 is a schematic illustration of an example control system for a drilling rig system according to the present disclosure.

FIG. 4 is a schematic illustration of an example control system 400 (or controller 400) for a drilling rig system. For example, the control system 400 can be used for the operations described previously, for example as or as part of the control system 124, control system 134, or other controllers described herein. For example, the control system 400 may be communicably coupled with, or as a part of, a drilling rig system (such as drilling rig system 100) as described herein.

The control system 400 is intended to include various forms of digital computers, such as printed circuit boards (PCB), processors, digital circuitry, or other hardware. Additionally the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The control system 400 includes a processor 410, a memory 420, a storage device 430, and an input/output device 440. Each of the components 410, 420, 430, and 440 are interconnected using a system bus 450. The processor 410 is capable of processing instructions for execution within the control system 400. The processor may be designed using any of a number of architectures. For example, the processor 410 may be a CISC (Complex Instruction Set Computers) processor, a RISC (Reduced Instruction Set Computer) processor, or a MISC (Minimal Instruction Set Computer) processor.

In one implementation, the processor 410 is a single-threaded processor. In another implementation, the processor 410 is a multi-threaded processor. The processor 410 is capable of processing instructions stored in the memory 420 or on the storage device 430 to display graphical information for a user interface on the input/output device 440.

The memory 420 stores information within the control system 400. In one implementation, the memory 420 is a computer-readable medium. In one implementation, the memory 420 is a volatile memory unit. In another implementation, the memory 420 is a non-volatile memory unit.

The storage device 430 is capable of providing mass storage for the control system 400. In one implementation, the storage device 430 is a computer-readable medium. In various different implementations, the storage device 430 may be a floppy disk device, a hard disk device, an optical disk device, or a tape device.

The input/output device 440 provides input/output operations for the control system 400. In one implementation, the input/output device 440 includes a keyboard, a pointing device, or both. In another implementation, the input/output device 440 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer.

Additionally, such activities can be implemented via touch-screen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any claims or of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A method comprising:

applying a first force to a drilling rig mast using a pair of hydraulic pistons coupled to a pair of front legs of the drilling rig mast, the first force acting in a first direction opposing a force in a second direction that is generated by a weight of the drilling rig mast;

in response to a failure of operation of at least one of the pair of hydraulic pistons in applying the first force to the drilling rig mast, applying a second force to the drilling rig mast using a plurality of raising lines coupled to a crown block of the drilling rig mast and to a pair of rear legs of the drilling rig mast opposite the front legs, the second force acting in the first direction opposing the force in the second direction that is generated by the weight of the drilling rig mast; and applying a third force to the drilling rig mast using the plurality of raising lines, the third force acting in the first direction opposing the force in the second direction that is generated by the weight of the drilling rig mast, wherein the first force and the third force are applied concurrently.

2. The method of claim 1, wherein the second force is greater than or equal to the force generated by the weight of the drilling rig mast.

3. The method of claim 1, wherein the first force moves the drilling rig mast between a horizontal orientation and a vertical orientation.

4. The method of claim 1, wherein applying the second force maintains a current vertical position of the drilling rig mast.

5. The method of claim 1, wherein applying the second force moves the drilling rig mast between a horizontal orientation and a vertical orientation.

6. The method of claim 1, wherein the first force is greater than the third force.

7. The method of claim 1, wherein the first force is nine times greater than the third force.

8. The method of claim 1, wherein applying the second force to the drilling rig mast using the plurality of raising lines comprises activating a drawworks assembly to apply the second force to at least one of the plurality of raising lines, the second force acting away from the crown block of the mast.

9. The method of claim 1, wherein the first force is greater than the second force.

10. The method of claim 1, wherein the first force is at least nine times greater than the second force.

11. The method of claim 1, wherein applying the first force to the drilling rig mast using the pair of hydraulic pistons coupled to the pair of front legs of the drilling rig mast moves the mast between a horizontal orientation and a vertical orientation.

12. The method of claim 1, wherein applying the second force to the drilling rig mast using the plurality of raising lines maintains a current vertical position of the mast.

13. The method of claim 1, wherein applying the second force to the drilling rig mast using the plurality of raising lines moves the mast between a horizontal orientation and a vertical orientation.

14. The method of claim 1, wherein applying the second force to the drilling rig mast using the plurality of raising lines further comprises rotating a portion of a drawworks assembly to increase the second force applied by the plurality of raising lines to the mast.

15. The method of claim 1, wherein applying the second force to the drilling rig mast using the plurality of raising lines comprises applying the second force to at least one of the plurality of raising lines using a drawworks assembly coupled to the plurality of raising lines.

16. The method of claim 15, wherein the second force is greater than or equal to the force generated by the weight of the drilling rig mast.

17. The method of claim 15, wherein applying the second force maintains a current vertical position of the drilling rig mast.

18. The method of claim 15, wherein applying the second force moves the drilling rig mast between a horizontal orientation and a vertical orientation.

19. The method of claim 1, wherein applying the second force to the drilling rig mast using the plurality of raising lines comprises engaging a brake of a drawworks assembly coupled to at least one of the plurality of raising lines.

20. The method of claim 19, wherein the second force is greater than or equal to the force generated by the weight of the drilling rig mast.

21. The method of claim 19, wherein applying the second force maintains a current vertical position of the drilling rig mast.

22. The method of claim 19, wherein applying the second force moves the drilling rig mast between a horizontal orientation and a vertical orientation.

23. The method of claim 19, wherein applying the second force to the drilling rig mast using the plurality of raising lines further comprises rotating a portion of the drawworks assembly to increase the second force applied by the plurality of raising lines to the mast.

24. The method of claim 23, wherein the second force is greater than or equal to the force generated by the weight of the drilling rig mast.

25. The method of claim 23, wherein applying the second force maintains a current vertical position of the drilling rig mast.

* * * * *